US007244014B2

(12) United States Patent
Goin et al.

(10) Patent No.: US 7,244,014 B2
(45) Date of Patent: Jul. 17, 2007

(54) MICRO-FLUID EJECTION DEVICES AND METHOD THEREFOR

(75) Inventors: Richard Louis Goin, Lexington, KY (US); Colin Geoffrey Maher, Georgetown, KY (US); James Harold Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 53 days.

(21) Appl. No.: 10/694,679

(22) Filed: Oct. 28, 2003

(65) Prior Publication Data

US 2005/0088486 A1 Apr. 28, 2005

(51) Int. Cl.
*B41J 2/05* (2006.01)

(52) U.S. Cl. ..... 347/65; 347/63

(58) Field of Classification Search ..... 347/20, 347/56, 61–65, 67, 44, 47, 92–94
See application file for complete search history.

(56) References Cited

U.S. PATENT DOCUMENTS

| | | | | |
|---|---|---|---|---|
| 4,694,308 | A | 9/1987 | Chan et al. | 347/47 |
| 5,291,226 | A | 3/1994 | Schantz et al. | 347/47 |
| 5,442,384 | A | 8/1995 | Schantz et al. | 347/20 |
| 5,648,805 | A | 7/1997 | Keefe et al. | 347/65 |
| 5,852,460 | A | 12/1998 | Schaeffer et al. | 347/47 |
| 6,024,440 | A * | 2/2000 | Murthy et al. | 347/65 |
| 6,158,843 | A | 12/2000 | Murthy et al. | 347/47 |
| 6,286,941 | B1 * | 9/2001 | Courian et al. | 347/65 |
| 6,322,200 | B1 | 11/2001 | Feinn et al. | 347/58 |
| 6,364,455 | B1 | 4/2002 | Yang et al. | 347/47 |
| 6,387,719 | B1 | 5/2002 | Mrvos et al. | 438/21 |
| 2002/0054191 | A1 | 5/2002 | Moon et al. | 347/56 |
| 2002/0093552 | A1 | 7/2002 | Yamamoto | 347/61 |
| 2002/0108243 | A1 | 8/2002 | Mou et al. | 29/890.1 |
| 2003/0038864 | A1 | 2/2003 | Mou et al. | 347/63 |

* cited by examiner

*Primary Examiner*—Juanita D. Stephens
(74) *Attorney, Agent, or Firm*—Luedeka, Neely & Graham

(57) ABSTRACT

An improved ink jet printhead for an ink jet printer and method therefor. The printhead includes a semiconductor substrate containing ink ejection devices. A thick film layer is attached to the substrate. A nozzle plate is attached to the thick film layer. The nozzle plate contains a plurality of ink ejection nozzles corresponding to the ink ejection devices. The printhead contains flow features having a height dimension and a width dimension formed therein for flow of ink to the plurality of ink ejection devices for ejection through the nozzles. At least a portion of the flow feature dimensions for at least one of the nozzles is formed in both the thick film layer and laser ablated in the nozzle plate, wherein the thick film layer contains at least 12% of the flow feature dimensions.

15 Claims, 6 Drawing Sheets

MICRO-FLUID EJECTION DEVICES AND METHOD THEREFOR

FIELD OF THE INVENTION

The invention relates to micro-fluid ejection devices such as ink jet printheads and methods for making micro-fluid ejection devices having improved ink flow characteristics.

BACKGROUND

A conventional micro-fluid ejection device such as an ink jet printhead generally has flow features either formed in a thick film layer deposited on a semiconductor substrate containing ink ejection devices or flow features ablated along with nozzles holes in a polymeric nozzle plate material. The term "flow features" is used to refer to ink chambers and ink supply channels that provide a fluid such as ink to ejection devices on the semiconductor substrate for ejection through nozzle holes. When both the nozzle holes and flow features are ablated in the nozzle plate material, a thick film material is not present. A disadvantage of forming the flow features and nozzle holes in the nozzle plate material is that the flow feature height and nozzle bore length are constrained by the nozzle plate material thickness. For printheads having a separate thick film layer and nozzle plate with the flow features formed in a thick film layer, the nozzle bore length is equal to the nozzle plate material thickness and the flow feature dimensions are constrained by the thickness of the thick film layer.

Another conventional printhead includes a planarization layer in addition to the nozzle plate material. The planarization layer was typically no more than about 2.5 microns thick. Accordingly, a small percentage of the total flow feature height dimension was formed in the planarization layer. However, the maximum percentage of the flow feature height dimension formed in the planarization layer was less than about 12 percent. Accordingly, the flow feature characteristics were effectively controlled by the thickness of the nozzle plate material and the dimensions of the flow features in the nozzle plate material.

Unfortunately, there are limited choices available for the nozzle plate material thickness. Chemical inertness to ink, adhesive ability, vendor availability, part durability, cost, and many other factors play a part in determining a suitable nozzle plate material and its thickness. Accordingly, there is often only one preferred material and only a select few nozzle plate material thicknesses available. The restriction on nozzle plate material thickness often leads to compromises in flow feature design and/or nozzle dimensions which may lead to reduced printhead performance and suboptimal performance.

As the speed of micro-fluid ejection devices such as ink jet printers increases, the frequency of ink ejection by individual heating elements also increases requiring more rapid refilling of the ink ejection chambers. Hence, there exists a need for improved micro-fluid ejection devices and methods for making the devices.

SUMMARY OF THE INVENTION

With regard to the foregoing, the invention provides an ink jet printhead for an ink jet printer. The printhead includes a semiconductor substrate containing ink ejection devices. A thick film layer is attached to the substrate. A nozzle plate is attached to the thick film layer. The nozzle plate contains a plurality of ink ejection nozzles corresponding to the ink ejection devices. The printhead contains flow features having a height dimension and a width dimension formed therein for flow of ink to the plurality of ink ejection devices for ejection through the nozzles. At least a portion of the flow feature dimensions for at least one of the nozzles is formed in both the thick film layer and laser ablated in the nozzle plate, wherein the thick film layer contains at least 12% of the flow feature dimensions.

In another embodiment, the invention provides a method for tuning an ink jet printhead to provide improved ink refill time for higher frequency ink ejection. The method includes the steps of providing a semiconductor substrate containing ink ejection devices on a device surface thereof. A thick film layer having a first thickness is deposited on the device surface of the semiconductor substrate. The thick film layer is then patterned and developed to form one or more ink supply channels and ink chambers having a first height dimension in the thick film layer. A laser ablated nozzle plate having a second thickness is attached to the thick film layer. The nozzle plate contains a plurality of ink nozzles having a nozzle bore length, a plurality of ink ejection chambers having a second height dimension, and a plurality of ink supply channels having a third height dimension. The second height dimension and the third height dimension range from about 0 microns to about 40 microns. The first height dimension is at least about 12% of a total of the first height dimension and second height dimension or the first height dimension and third height dimension.

An advantage of the invention is that it enables independent variation of the nozzle bore length and the flow feature height. Independent variation of the nozzle bore length and flow feature height is achieved by combining flow features formed in thick film layer with flow features and nozzle holes formed in a nozzle plate material. As a result, the invention enables more freedom to design flow features and nozzles for printheads that produce the best quality images without resorting to the use of non-conventional nozzle plate material thicknesses.

Another advantage of the invention is that the cross sectional area of the ink feed channels to the ink chambers can be increased without affecting the nozzle bore length. An increase in the cross sectional area of the ink feed channel can be used to decrease the refill time of the ink chambers and therefore increase the operating or firing frequency of the printhead. An increased cross sectional area may be especially helpful for ink chambers positioned relatively far from the ink feed slot. In that regard, adjacent ink feed channels and ink chambers may be provided with different cross-sectional dimensions in the same printhead. This advantage is not easily provided by conventional printhead fabrication methods.

BRIEF DESCRIPTION OF THE DRAWINGS

Further advantages of the invention can be better understood by reference to the detailed description when considered in conjunction with the figures, which are not to scale and which are provided to illustrate the principles of the invention. In the drawings, like reference numbers indicate like elements through the several views.

DETAILED DESCRIPTION OF THE INVENTION

Figure 1:
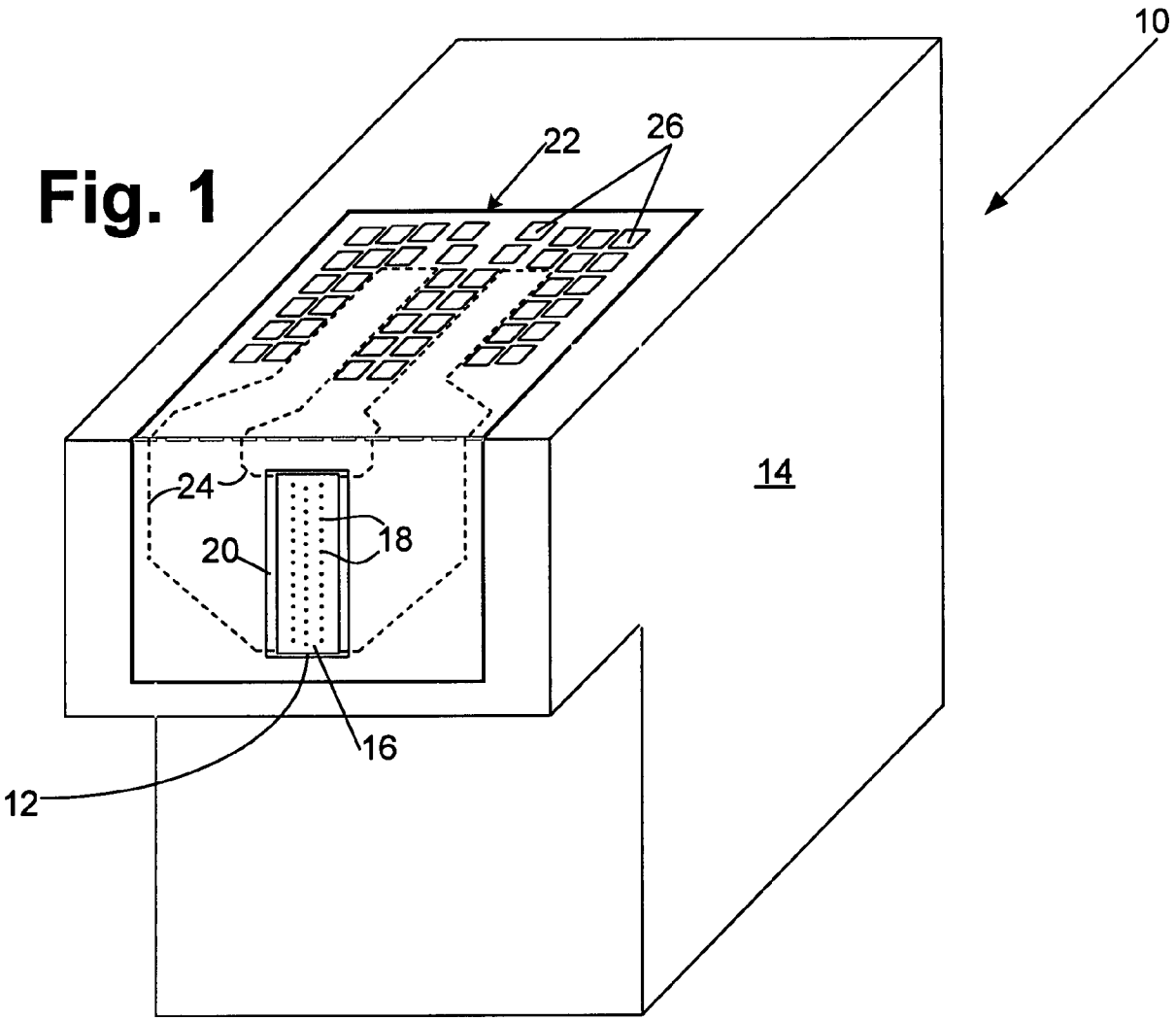
FIG. 1 is a perspective view, not to scale, of a fluid cartridge and micro-fluid ejection device according to the invention.

With reference to FIG. 1, a fluid supply cartridge 10 for use with a device such as an ink jet printer includes a printhead 12 fixedly attached to a fluid supply container 14 as shown in FIG. 1 or removably attached to a fluid supply container either adjacent to the printhead 12 or remote from the printhead 12. In order to simplify the description, reference will be made to inks and ink jet printheads. However, the invention is adaptable to other micro-fluid ejecting devices other than for use in ink jet printers and thus is not intended to be limited to ink jet printers.

The printhead 12 preferably contains a nozzle plate 16 containing a plurality of nozzle holes 18 each of which are in fluid flow communication with a fluid in the supply container 14. The nozzle plate 16 is preferably made of an ink resistant, durable material such as polyimide and is attached to a semiconductor substrate 20 that contains ink ejection devices as described in more detail below. The semiconductor substrate 20 is preferably a silicon semiconductor substrate.

Ejection devices on the semiconductor substrate 20 are activated by providing an electrical signal from a controller to the printhead 12. The controller is preferably provided in a device to which the supply container 14 is attached. The semiconductor substrate 20 is electrically coupled to a flexible circuit or TAB circuit 22 using a TAB bonder or wires to connect electrical traces 24 on the flexible or TAB circuit 22 with connection pads on the semiconductor substrate 20. Contact pads 26 on the flexible circuit or TAB circuit 22 provide electrical connection to the controller in the printer for activating the printhead 12.

The flexible circuit or TAB circuit 22 is preferably attached to the supply container 14 using a heat activated or pressure sensitive adhesive. Preferred pressure sensitive adhesives include, but are not limited to phenolic butyral adhesives, acrylic based pressure sensitive adhesives such as AEROSET 1848 available from Ashland Chemicals of Ashland, Ky. and phenolic blend adhesives such as SCOTCH WELD 583 available from 3M Corporation of St. Paul, Minn.

During a fluid ejection operation such as printing with an ink, an electrical impulse is provided from the controller to activate one or more of the ink ejection devices on the printhead 12 thereby forcing fluid through the nozzles holes 18 toward a media. Fluid is caused to refill ink chambers in the printhead 12 by capillary action between ejector activation. The fluid flows from a fluid supply ink container 14 to the printhead 12.

It will be appreciated that micro-fluid ejection devices such as ink jet printers continue to be improved to provide higher quality images. Such improvements include increasing the number of nozzle holes and ejection devices on a semiconductor substrate, reducing the size of the nozzle holes and substrate, and increasing the frequency of operation of the ejection devices.

Improvements in the operation and quality of images produced by an ink jet printer are highly dependent on ink flow characteristics of the printheads. For example, the operational frequency of an ink jet printhead is limited by the time required to replenish ink to an ink chamber adjacent the ink ejection device. Refill times are affected by the flow feature dimensions of the printhead.

Figure 2:
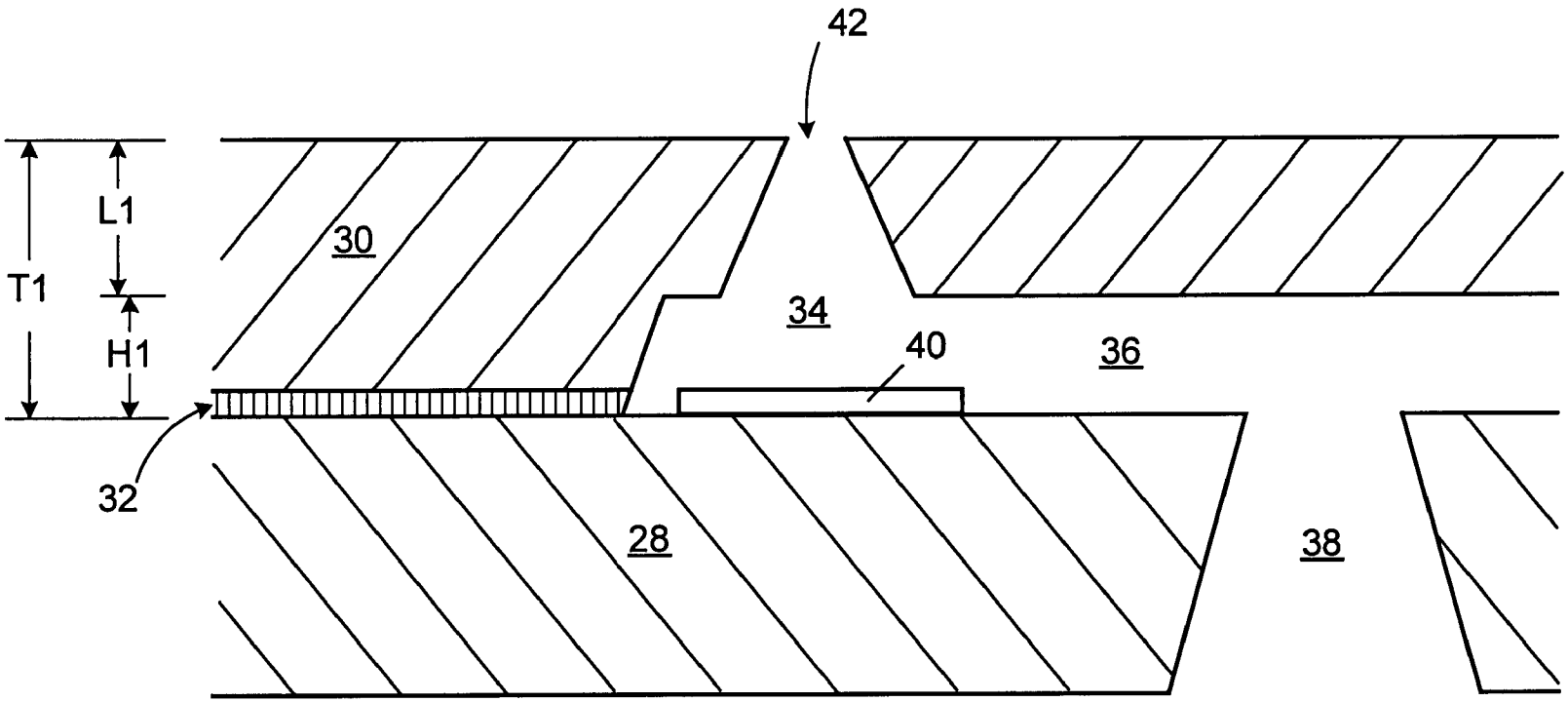
Fig. 2 Prior Art
FIG. 2 is cross-sectional view, not to scale, of a portion of a prior art ink jet printhead wherein flow features and nozzle holes are formed in a nozzle plate material.
Figure 3:
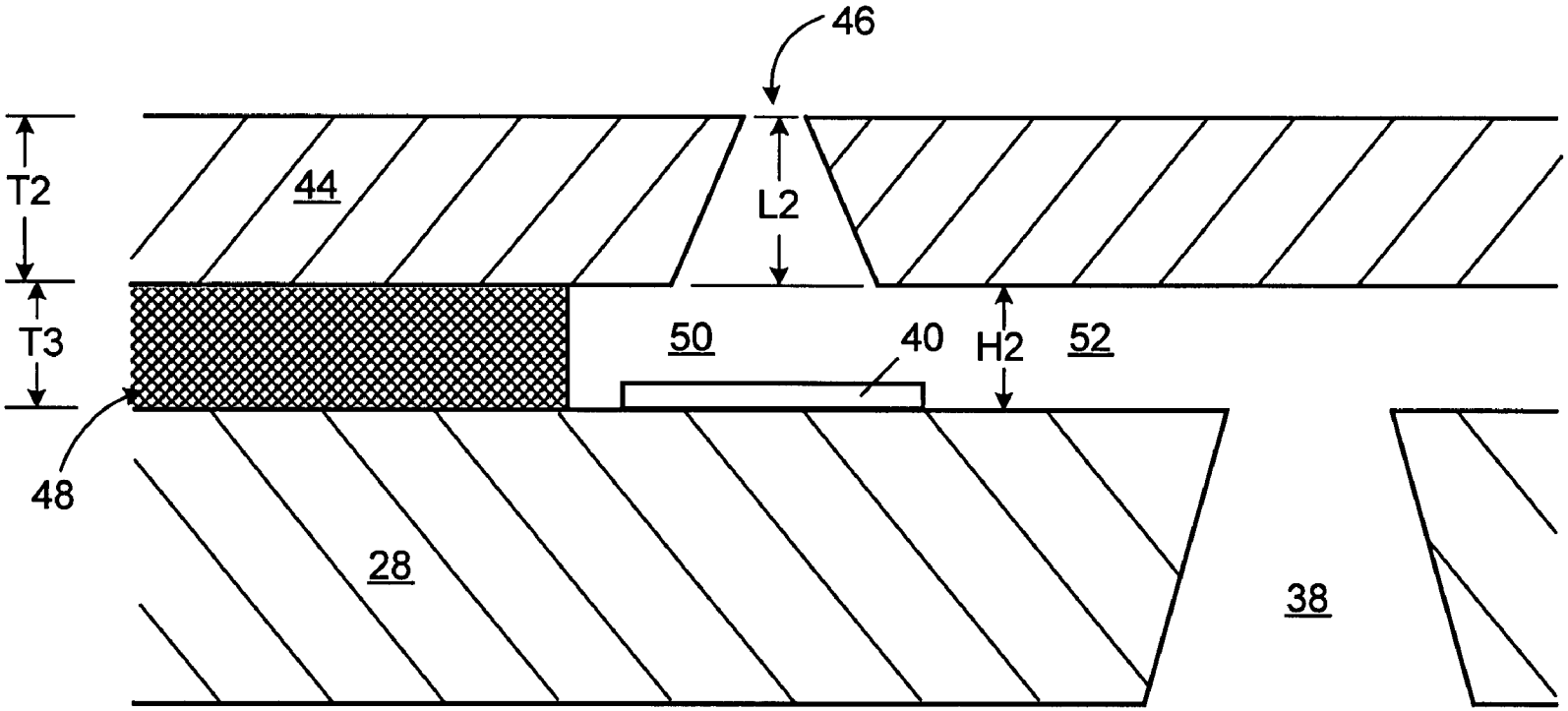
Fig. 3 Prior Art
FIG. 3 is cross-sectional view, not to scale, of a portion of a prior art ink jet printhead wherein flow features are formed in a thick film layer and nozzle holes are formed in a separate nozzle plate material.

There are basically two types of printhead constructions for "top shooter" type printheads. A "top shooter" is defined as a printhead having a nozzle plate attached atop a semiconductor substrate containing the ink ejection devices. Ink ejection is substantially perpendicular to an ink flow channel that supplies ink to an ink chamber adjacent the ejection device. FIGS. 2 and 3 represent simplified illustrations of the two conventional types of printhead constructions for a "top shooter" type printhead.

In FIG. 2, the printhead 27 includes a semiconductor substrate 28 and a nozzle plate 30 attached by use of a thin film adhesive 32 to the semiconductor substrate. As shown in FIG. 2, flow features are formed in the nozzle plate material as by laser ablation when the nozzle plate 30 is made of a polyimide material. The flow features may be formed in a metal nozzle plate material as by casting or machining the material.

The flow features include an ink chamber 34 and an ink supply channel 36 for flow of ink from an ink feed slot 38 in the substrate 28 to the vicinity of the ink ejection device 40. Other flow features, such as filter pillars may also be formed in the nozzle plate 30 adjacent the ink supply channels 36. Upon activation of the ink ejection device 40, ink is urged through a nozzle 42 also formed in the nozzle plate 30.

As shown in FIG. 2, the flow features have a height of H1 (including the thin film adhesive 32) and the nozzle 42 has a nozzle bore length L1. The overall thickness T1 of the nozzle plate 30 and thin film adhesive 32 is necessarily equal to H1+L1. Hence for a given thickness T1 of nozzle plate material, as the nozzle bore length L1 is increased the flow features height H1 must be decreased and vice versa. In order to increase both the bore length L1 and the flow features height H1 a thicker nozzle plate material would be required. However, since nozzle plate materials, in the case of polyimide, are only available in standard thicknesses, custom fabrication of the nozzle plate material would be required to vary the dimensions significantly.

In another prior art design, illustrated in FIG. 3, printhead 43 includes a nozzle plate 44 containing only nozzles 46. The nozzle plate 44 is attached to a thick film layer 48. The thick film layer 48 is deposited on the semiconductor substrate 28 and is used to provide the flow features including an ink ejection chamber 50 and ink supply channel 52. Suitable thick film layers 48 include positive and negative photoresist materials that may be spin coated onto the substrate 28.

In this design, the nozzle bore length L2 is limited to the nozzle plate thickness T2. The height H2 of the flow features is limited to the thickness T3 of the thick film layer 48. As in the previously described design, the bore length L2 is limited by the availability of materials used for making the nozzle plate 30. The height dimension H2 of all of the flow features cannot be easily varied for adjacent ink supply channels 52 and ink chambers 50.

Figure 4:
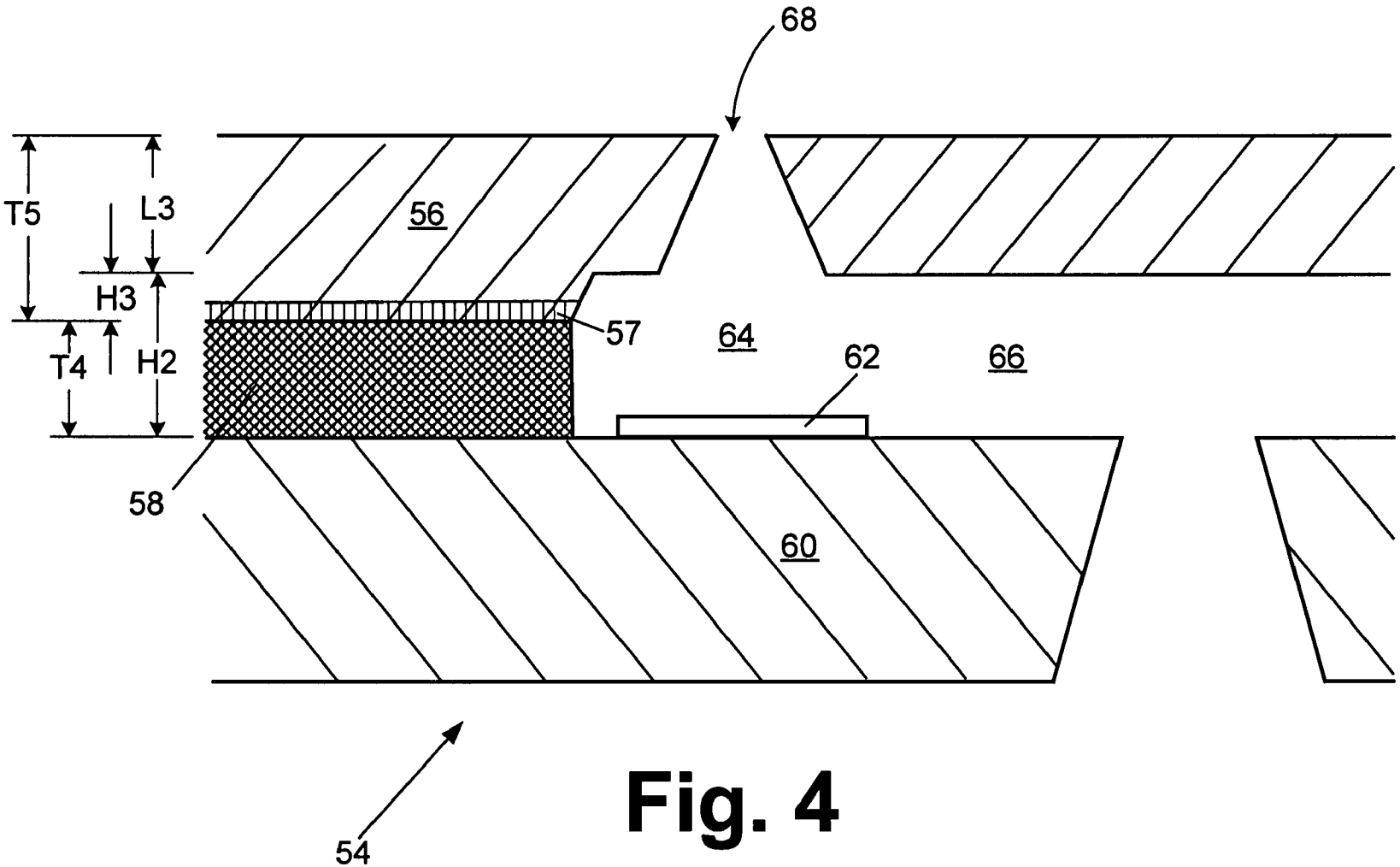
FIG. 4 is a cross-sectional view, not to scale, of a portion of a micro-fluid ejection device according to one embodiment of the invention.
Figure 5:
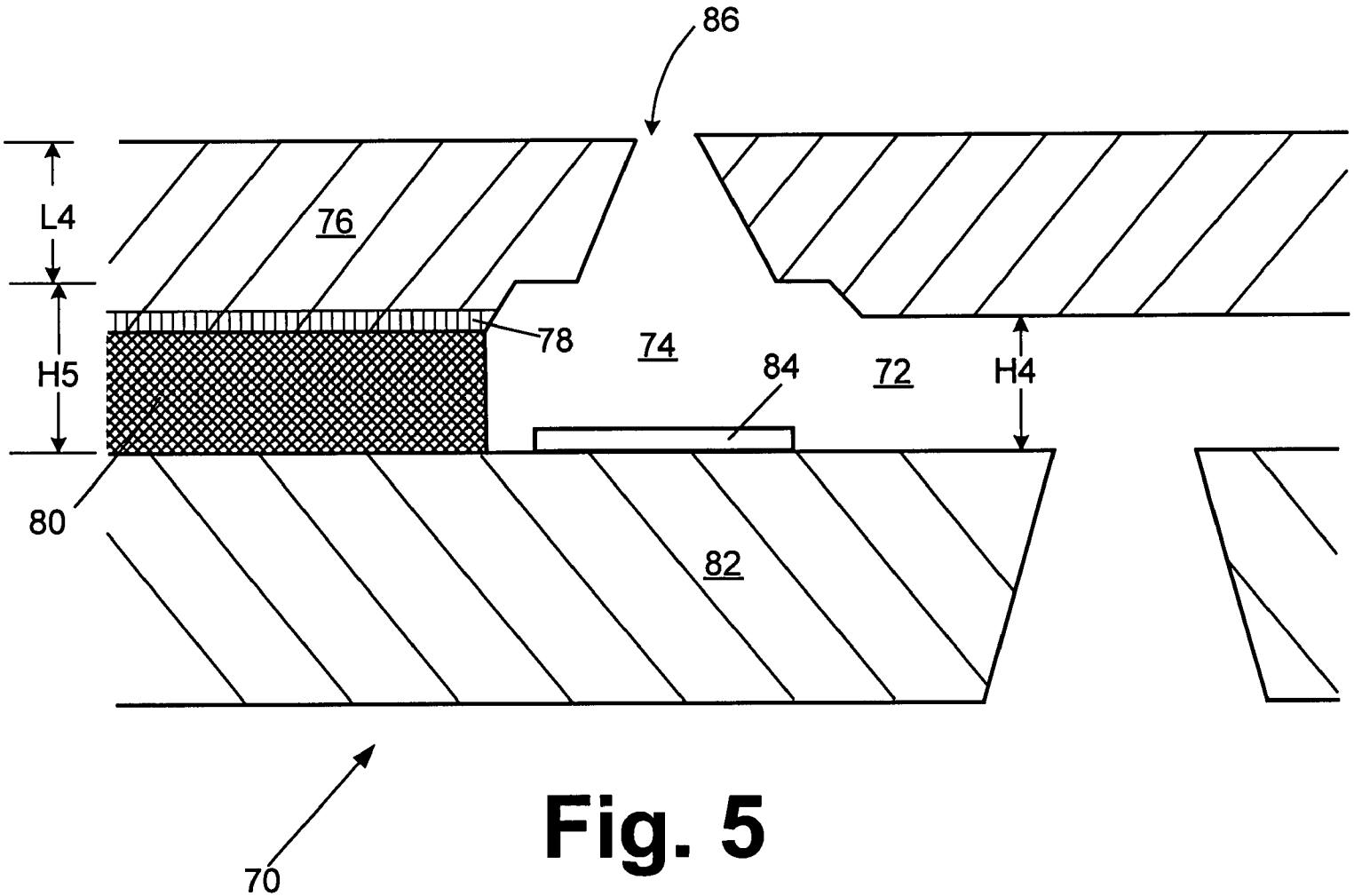
FIG. 5 is a cross-sectional view, not to scale of a portion of a micro-fluid ejection device according to another embodiment of the invention.

Turning now to FIGS. 4 and 5, various aspects of the invention will now be described. A printhead 54, according to the invention, generally includes a laser ablated nozzle plate 56 preferably made of polyimide. In this embodiment, the nozzle plate 56 includes a portion of the flow features laser ablated into the nozzle plate material prior to attaching the nozzle plate to a thick film layer 58 deposited on a semiconductor substrate 60.

Materials suitable for nozzle plate 56 according to the invention are generally available in thicknesses ranging from about 25 to about 70 microns. Typically, the nozzle plate material has a thickness of 25.4 microns, 27.9 microns, 38.1 microns, or 63.5 microns. Of the total thickness of the nozzle plate material, 2.54 or 12.7 microns is comprised of an adhesive layer 57 that is applied by the manufacturer to the nozzle plate material. It will be understood however, that the invention is also applicable to a nozzle plate material that is provided absent the adhesive layer. In this case, an adhesive be applied separately to attach the nozzle plate 56 to the thick film layer 58.

The thick film layer 58 is preferably provided by spin coating a positive or negative photoresist material onto the substrate 60. As with the nozzle plate 56, the thick film layer 58 is preferably patterned and developed before attaching the laser ablated nozzle plate 56 to the thick film layer 58. The thick film layer 58 is preferably applied to the substrate with a thickness ranging from about 5 to about 15 microns.

As described above, the substrate 60 includes an ink ejection device 62 such as a heater resistor. However, the invention may be adaptable to other ejection devices such as piezoelectric ejection devices.

Unlike the previous printheads 27 and 43 described above, the printhead 54 made according to the invention can have flow feature dimensions that are relatively independent of the thicknesses of the nozzle plate/adhesive 56/57 and thick film layer 58. For example, a thick film layer 58 having a thickness T4 provides a portion of height H2 of an ink chamber 64 and ink supply channel 66. A portion H3 of the height H2 of the ink chamber 64 and ink supply channel 66 is also laser ablated into the nozzle plate/adhesive 56/57 as shown in FIG. 4. Likewise, the bore length L3 of nozzle 68 is relatively independent of the thickness T5 of the nozzle plate/adhesive 56/57 and is not dependent on the thickness of the thick film layer 58.

As shown in FIG. 5, a printhead 70 may be fabricated according to the invention with an ink channel 72 having a height H4 different from a height H5 of an ink chamber 74. Such a design is possible by using a laser ablated nozzle plate/adhesive 76/78 attached to a thick film layer 80 on a semiconductor substrate 82 containing an ejection device 84. Accordingly, use of both a laser ablated nozzle plate/adhesive 76/78 and thick film layer 80 advantageaously enables a wide variety of dimensions for the flow features and nozzle 86 bore length L4 while enabling independent control of the dimensions of each without respect to availability of materials for constructing the nozzle plate/adhesive 76/78.

For example, a preferred polyimide nozzle plate material/adhesive has a thickness selected from 38.1 microns and 63.5 microns. Using these available dimensions, assume that a desired nozzle bore length is 30 microns, and the desired flow feature height is 16 microns. The desired dimensions cannot be obtained with the laser ablated nozzle plate 30 as described in FIG. 2 because L1+H1=30+16=46 microns which is greater than the nozzle plate/adhesive layer thickness of 38.1 microns. Likewise, the desired dimensions cannot be obtained by using a nozzle plate/adhesive layer having a thickness of 63.5 microns as 46 microns is less than 63.5 microns.

As shown in FIG. 4, the desired dimensions can be achieved by using a 38.1 micron thick nozzle plate/adhesive 56/57 and a 7.9 micron thick film layer 58. In this case, a portion, 8.1 microns, of the flow features height H2 is laser ablated into the nozzle plate/adhesive 56/57 to provide the desired flow feature height of 16 microns (8.1 microns plus 7.9 microns). The nozzle 68 may be ablated in the remaining nozzle plate/adhesive 56/57 to have a bore length of 30 microns. Furthermore, as shown in FIG. 5, H4 may be made greater or less than H5. Such variation is not obtainable with the separate thick film layer 48 and nozzle plate 44 shown in FIG. 3. By combining thick film flow features with flow features and nozzles ablated in a nozzle plate/adhesive, the flow feature height and the nozzle bore length are far less constrained by the nozzle plate/adhesive thickness.

Figure 6:
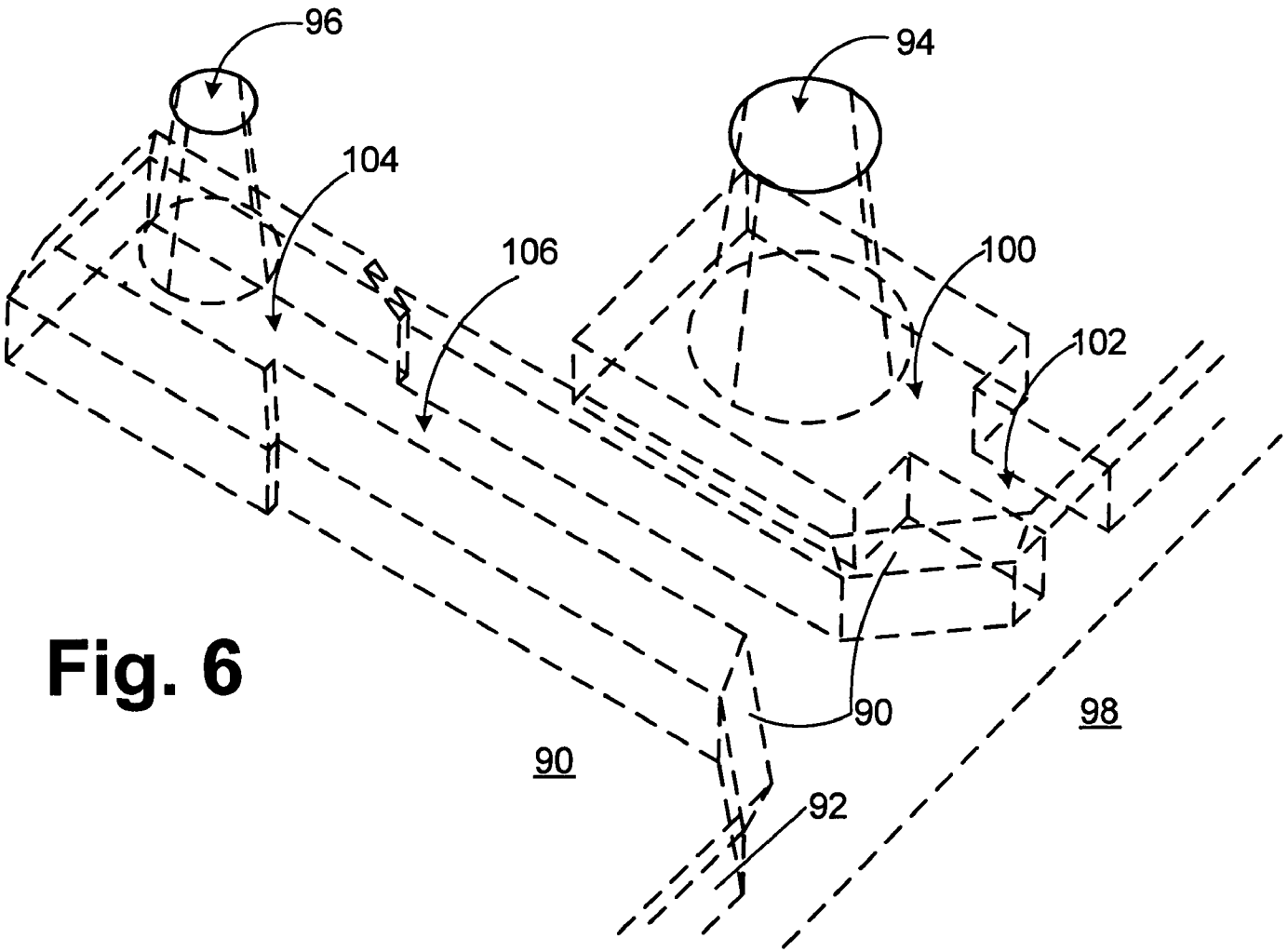
FIG. 6 is a perspective view, not to scale, of a portion of a micro-fluid ejection device according to another embodiment of the invention.

Another important advantage of the invention is illustrated in FIG. 6. A portion of a nozzle plate/thick film layer 90/92 is shown in FIG. 6 containing two nozzles 94 and 96. In this example, the nozzle plate 90 includes an adhesive (not shown for simplification). According to FIG. 6, nozzle 94 is a relatively large nozzle disposed relatively close to an ink feed slot 98. Nozzle 96 is a relatively smaller nozzle disposed further from the ink feed slot 98 than nozzle 94. In the alternative, both nozzles may be substantially the same size while one nozzle is closer to the feed slot 98 than the other.

In this embodiment, ink chamber 100 and ink flow channel 102 may be formed with different height and/or width dimensions than ink chamber 104 and ink flow channel 106. For example, nozzle 94 may be formed only in the nozzle plate 90 and ink chamber 100 and ink flow channel 102 may be formed only in the thick film layer 92. In contrast, ink chamber 104 and ink channel 106 may be formed partly in the thick film layer 92 and partly in the nozzle plate 90 as shown. Even with nozzles of substantially the same size, the invention enables each of the flow channels 102 and 106 height and/or width and each of the ink chambers 100 and 104 height and/or width to be varied to tune the frequency response of the nozzles depending on their proximity to the ink feed slot 98.

Variations in the flow feature dimensions for nozzles 94 and 96 enable tuning of fluid flow to ink ejection devices in the ink chambers 100 and 104. For example, even though nozzle 96 is relatively further away from the ink feed slot 98 than nozzle 94, refill times for the ink ejection chambers 100 and 104 can be made similar by increasing the cross-sectional area of ink feed channel 106 by forming part of the channel 106 in the nozzle plate 90 and part of the channel 106 in the thick film layer 92. Correspondingly, the bore length of nozzle 96 will be shorter than the bore length of nozzle 94. However, the smaller nozzle 96 can operate effectively with a shorter nozzle bore length. Such variation in flow feature dimension between nozzles 94 and 96 in a single nozzle plate or printhead cannot be effectively achieved with conventional printhead construction techniques or with film layers 92 having a thickness of 2.5 microns or less.

While FIG. 6 may depict alternating large and small nozzles 94 and 96 and associated flow features, the invention is not limited to such arrangement. Accordingly, all of the nozzles may be the same size, or all of the small nozzles 96 may be disposed on one side of the ink feed slot 98 and all of the large nozzles 94 disposed on an opposite side of the ink feed slot 98. There may also be a random arrangement of large and small nozzles 94 and 96, or a predetermined pattern of large and small nozzles 94 and 96 may be provided. Regardless of the arrangement of large and small nozzles 94 and 96, the invention provides the flexibility to tune the flow features for each nozzle for optimum flow of ink or fluid to and through the nozzles.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. An ink jet printhead for an ink jet printer, comprising a substrate containing ink ejection devices, a thick film layer attached to the substrate, and a nozzle plate attached to the thick film layer, the nozzle plate containing a plurality of ink ejection nozzles corresponding to the ink ejection devices, and the printhead containing flow features having a height dimension and a width dimension formed therein for flow of ink from an ink feed slot through ink flow channels in the thick film layer directly connecting the ink feed slot with the plurality of ink ejection devices for ejection through the nozzles, wherein at least a portion of the flow feature dimensions for at least one of the ejection devices is formed in both the thick film layer and laser ablated in the nozzle plate, and wherein the thick film layer contains at least 12% of the flow feature dimensions.

2. The ink jet printhead of claim 1 wherein the flow features include an ink chamber and an ink flow channel in flow communication with the ink chamber.

3. The ink jet printhead of claim 1 wherein the printhead comprises substantially all of the flow features formed in both the nozzle plate and the thick film layer.

4. The ink jet printhead of claim 1 wherein the nozzle plate has a thickness ranging from about 25 to about 70 microns.

5. The ink jet printhead of claim 4 wherein the ink ejection nozzles have a bore length ranging from about 20 to about 65 microns.

6. The ink jet printhead of claim 4 wherein the thick film layer has a thickness ranging from about 5 to about 15 microns.

7. The ink jet printhead of claim 6 wherein the flow features have a height dimension ranging from about 5 to about 30 microns.

8. The ink jet printhead of claim 7 wherein about 20 to about 80% of the flow features height dimension is formed in the nozzle plate.

9. The ink jet printhead of claim 1 wherein the flow features laser ablated in the nozzle plate have at least two different height dimensions.

10. An ink jet printhead comprising:

a substrate having ink ejection devices thereon;

a thick film layer attached to the substrate and having first portions of ink flow features including an ink chamber and an ink flow channel in flow communication with the ink chamber formed therein for flow of ink directly from an ink feed slot through the flow channel to the ink chamber; and a nozzle plate attached to the thick film layer opposite the substrate, the nozzle plate defining ink ejection nozzles and containing second portions of ink flow features formed therein by laser ablation, wherein the first portions are at least 12% of a total of the first and second portions.

11. The inkjet printhead of claim 10 wherein the nozzle plate has a thickness ranging from about 25 to about 70 microns.

12. The ink jet printhead of claim 11 wherein nozzle plate contains ink ejection nozzles having a bore length ranging from about 20 to about 65 microns.

13. The ink jet printhead of claim 11 wherein the thick film layer has a thickness ranging from about 5 to about 15 microns.

14. The ink jet printhead of claim 13 wherein the flow features have a height dimension ranging from about 5 to about 30 microns.

15. The ink jet printhead of claim 14 wherein about 20 to about 80% of the flow features height dimension is formed in the nozzle plate.

* * * * *